US005762003A

United States Patent [19]

Downes et al.

[11] Patent Number: 5,762,003

[45] Date of Patent: Jun. 9, 1998

[54] RAILROAD HOPPER CAR UNDERFRAME TRANSITION CASTING

[75] Inventors: John R. Downes, Columbus; Carl D. McClurg, Lockbourne, both of Ohio

[73] Assignee: Buckeye Steel Castings Company, Columbus, Ohio

[21] Appl. No.: 805,997

[22] Filed: Feb. 24, 1997

[51] Int. Cl.[6] ..... B61D 17/00

[52] U.S. Cl. ..... 105/416; 105/247; 105/251

[58] Field of Search ..... 105/239, 245, 105/248, 247, 250, 251, 355, 404, 409, 410, 413, 416, 421, 420

[56] References Cited

U.S. PATENT DOCUMENTS

| | | | |
|---|---|---|---|
| 999,791 | 8/1911 | Ingoldsby | 105/245 |
| 3,538,857 | 11/1970 | Larssen | 105/420 |
| 3,561,370 | 2/1971 | Reynolds | 105/420 |
| 3,770,139 | 11/1973 | Glenn | 213/57 |
| 3,774,554 | 11/1973 | O'Neill et al. | 105/416 |
| 3,797,674 | 3/1974 | Reynolds | 213/57 |
| 4,029,022 | 6/1977 | McClurg | 105/420 |
| 4,042,117 | 8/1977 | McClurg | 213/50.5 |
| 4,128,062 | 12/1978 | Roberts | 105/420 |
| 4,331,083 | 5/1982 | Landregan et al. | 105/416 |
| 4,493,266 | 1/1985 | Augustine | 105/245 |
| 5,216,958 | 6/1993 | Kurtz | 105/416 |
| 5,462,139 | 10/1995 | Jones, Jr. et al. | 188/206 |

OTHER PUBLICATIONS

Drawing CX–5333, Covered Hopper Car Chart, prepared by The Railway Educational Bureau, Omaha, NE, 1956.

*Primary Examiner*—Mark T. Le

*Attorney, Agent, or Firm*—Banner & Witcoff, Ltd.

[57] ABSTRACT

A railroad hopper car for carrying loads of commodities comprises spaced trucks and a car body supported on the spaced trucks. The car body includes an underframe having a center sill, with discharge openings, the center sill in the area of the discharge openings toward the loaded commodities having surfaces sloped toward the discharge openings. The underframe has members connecting the car body to the spaced trucks. These members have shapes distinct from the shape of the center sill. The car body further includes transition members between the center sill and underframe members connecting the car body to the spaced trucks. The transition members along the center sill are sized and shaped to fit with the center sill, and the transition members along the underframe members are sized and shaped to fit with the underframe members. The transition members transition between the center sill and underframe members, allowing the center sill to have sloped surfaces while the underframe members have other shapes. The described structure has the advantages, among others, of eliminating bulky structures, such as center sill hoods, to provide sloped surfaces to center sills, and eliminating flat topped sills. Loaded commodities in increased volumes and weights discharge past sloped upper surfaces of center sills, combining the best of the eliminated structures and flat topped center sills without added structures.

11 Claims, 5 Drawing Sheets

RAILROAD HOPPER CAR UNDERFRAME TRANSITION CASTING

BACKGROUND OF THE INVENTION

This invention relates to railroad hopper cars, and more particularly to construction of the under frames of such cars, in the area of the bottoms and discharge openings of such cars. This invention most specifically relates to construction of center sills of railroad hopper car underframes, and the associated frame members of the cars.

The currently prevalent construction of railroad cars includes car bodies of desired length, width, height, function, strength and associated attributes. The car bodies are supported on trucks at either end of each car body. The trucks include the wheels of the railroad cars and associated wheel frame members. Two side frames of the trucks are located parallel to the wheels and rails, and a truck bolster extends transversely between the wheels and side frames. The side frames, truck bolster and wheels make up the trucks of the car. The car body has a center plate for each truck, which fits in a center bowl atop a truck bolster, for flexible connection of the car body to the trucks.

In a currently prevalent hopper car construction, a center sill extends along the length of the hopper car body, as part of the under frame. The center sill extends to fabricated draft sills or cast draft arms, which extend to strikers spaced at either end of a car. The center plate, which provides the connection to the center bowl on the truck bolster, is cast integral to the draft arm or attached to the draft arm or fabricated sill. Closable openings for the discharge of bulk commodities such as coal and grain are located in the under frame of the hopper cars, in series along both sides of the center sill. Conventionally, for strength, the center sill is generally rectangular, with a closed or open bottom surface, and with flat sides and a flat top. The center sill is often formed by welding together two elongated Type C sill members. The Type Z sill is another common sill.

Also conventionally, with such a center sill, a center sill hood and center sill hood stiffeners are added to the car to provide sloped surfaces atop the center sill, to eliminate any tendency of commodities inside the cars to rest atop the sill and fail to discharge.

For a disclosure of a railroad car truck assembly, U.S. Pat. No. 5,462,139 issued Oct. 31, 1995 is incorporated by reference. For a disclosure of a railroad car body assembly, Drawing No. CX-5333, prepared by The Railway Educational Bureau of Omaha, Nebr. is incorporated by reference.

SUMMARY OF THE INVENTION

A disadvantage of conventional railroad hopper cars is that with conventional center sills, structures, such as, a center sill hood and center sill hood stiffeners, must be added to the cars to provide sloped surfaces atop the center sill. These structures add weight to the cars, and reduce volume within the cars. Weight is important, since total weight of each car and its contents is limited by rail line owners. Volume is important for efficiency. Sometimes the inner body of the cars are lined or coated to prevent contamination of the loaded commodities. Conventional center sill hoods have sharp corners or edges that are difficult to line evenly. Often, the lining on these sharp edges wears first resulting in contamination of the lading.

Another disadvantage of conventional railroad hopper cars is that without the center sill hood to provide the sloped surfaces, loaded commodities have a tendency to rest atop flat sills and fail to discharge. Complete discharge is important to assure complete delivery of loads to their destinations, to prevent costs for completing the emptying of cars or transportation of load residues, to minimize accidents of manual procedures, and to prevent intermixing of early and subsequent loads.

These and associated disadvantages too detailed and numerous to mention are overcome by the invention(s) of this description. The invention has the advantages, among others, of eliminating bulky center sill hoods and associated stiffeners with sharp corners to provide sloped surfaces to center sills, and eliminating flat topped sills. With the invention(s) of this description, loaded commodities in increased volumes and weights discharge past sloped upper surfaces of center sills having rounded corners, combining the best of the eliminated structures and flat topped center sills without added structures.

As preferred, the central invention of this description comprises in one form a railroad hopper car for carrying loads of commodities, comprising spaced trucks and a car body supported on the spaced trucks. The car body includes an underframe having a center sill with rounded corners, with discharge openings, the center sill in the area of the discharge openings toward the loaded commodities having surfaces sloped toward the discharge openings. The underframe has members connecting the car body to the spaced trucks. These members have shapes distinct from the shape of the center sill. The car body further includes transition members between the center sill and underframe members connecting the car body to the spaced trucks. The transition members along the center sill are sized and shaped to fit with the center sill, and the transition members along the underframe members are sized and shaped to fit with the underframe members. The transition members transition between the center sill and underframe members, allowing the center sill to have sloped surfaces with rounded corners while the underframe members have other shapes.

In another form of the invention, the invention comprises a transition member as described.

A full understanding of the objects, advantages and limitations of the invention are best understood by a complete reading of this specification, including a detailed description of the preferred embodiments, which follows, after a brief description of the accompanying drawing.

BRIEF DESCRIPTION OF THE DRAWING

The preferred embodiments of the invention(s) will hereafter be described with reference to the accompanying drawings. The drawings consist of ten figures. Each figure is briefly described as follows.

Figure 1:
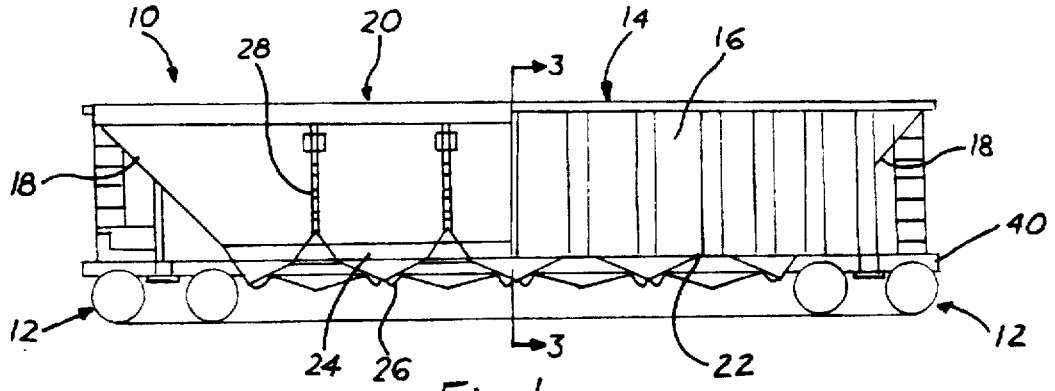
FIG. 1 is an elevation view of a railroad hopper car (prior art)

In the following description and in the accompanying drawings, like reference numerals designate identical parts throughout the description and drawing. Words of orientation such as "top," "bottom" and the like are provided based on orientation of structures in use on level track, and provided for ease of understanding of the preferred embodiments by persons of ordinary skill in the art; these terms do not limit the scope of any patent claim unless incorporated in the claim under consideration. The following is a list of parts and associated numerals identified in the description and accompanying drawings:

| | | | | | |
|---|---|---|---|---|---|
| railroad hopper car | 10 | spaced trucks | 12 | car body | 14 |
| side walls | 16 | end walls | 18 | car top | 20 |
| car bottom | 22 | bay | 24 | discharge opening | 26 |
| braces | 28 | mounting bracket | 30 | center sill | 40 |
| center sill hood | 42 | center plate | 99 | underframe member | 100 |
| flange | 101 | transition member | 102 | hollow opening | 103 |
| transition end | 104 | added material | 105 | fin-shaped flange | 106 |
| first curve | 108 | transition body | 109 | second curve | 110 |
| transition area | 112 | corners | 114 | corners | 116 |
| diamond-shaped transition body | 118 | center sill connection portion | 130 | underframe member connection portion | 132 |
| transition end | 120 | | | | |

DETAILED DESCRIPTION OF THE PREFERRED EMBODIMENTS

Figure 2:
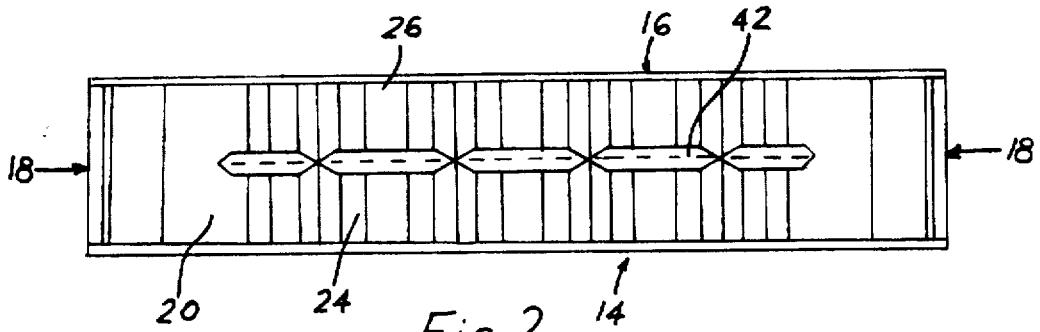
FIG. 2 is a plan view of the hopper car of FIG. 1 (prior art)

Referring to FIG. 1, a railroad hopper car 10 which carries loads of commodities comprises spaced trucks 12 and a car body 14 supported on the spaced trucks 12. Referring to FIGS. 1 and 2, the car body 14 can have side walls 16, end walls 18, and an open or a closed top 20 to protect the commodities from dirt, moisture and other contaminants. The closed top 20 can also be fitted with a trough-style roof hatch for faster loading. The car body 14 can have side walls 16 with a smooth exterior or, as shown in FIG. 1, a ribbed exterior for withstanding stress from rotary car dumps and a smooth interior for faster unloading. The side walls 16 may be trusses for strength. A ribbed exterior is shown at the right of cross-section 3—3 while a smooth interior is shown at the left.

The end walls 18 and the bottom 22 of the car body are sloped for funneling the carried commodities to discharge opening 26 located at the bottom of the bay 24. Typical hopper cars have between one and four bays. The number of bays depends largely on the weight of the carried cargo.

Figure 3:
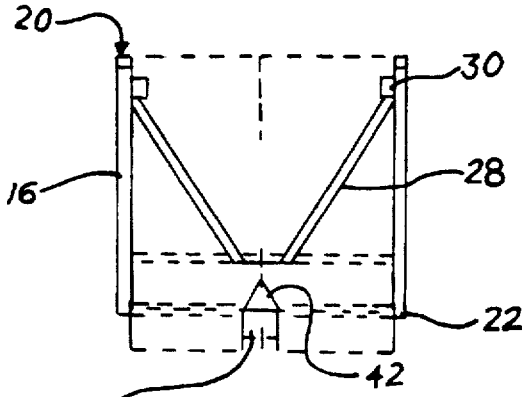
FIG. 3 is a cross-section of the hopper car taken along lines 3—3 of FIG. 1 (prior art)

Referring to FIGS. 1 and 3, braces 28 are spaced within the interior of the car body to provide additional lateral support to the side walls 16. These braces 28 extend from the bottom of the car body 22 near the bay 24 to a mounting bracket 30 located on the interior of the side wall 16 near the top 20 of the car body 14.

A center sill 40 is located below the car body 14, along its centerline, for transmitting draft and buff (longitudinal coupler) loads through the hopper car 10 to the next rail car. The center sill 40 extends from one truck 12 to the other and conventionally has a hollow rectangular cross-section with a flat top and either an open or closed bottom. Referring to FIGS. 2 and 3, in the prior art, at the bottom 22 of the car body 14 and perpendicular to the bay 24, a center sill hood 42 is added immediately above the flat topped center sill 40, along the length of the center sill 40, to provide a sloped surface from the center sill to the discharge openings 26. The purpose of the center sill hood 42 is to prevent the loaded commodities from adhering to or staying on the center sill 40 and cause all the commodities to discharge through the discharge openings 26. Referring to FIG. 3, this prior art center sill hood 42 has a hollow, triangular or wedge-shaped cross-section with sharp corners and is located directly above the center sill 40. The center sill hood is supported by center sill stiffeners which are located along the length of the center sill 40.

Figure 10:
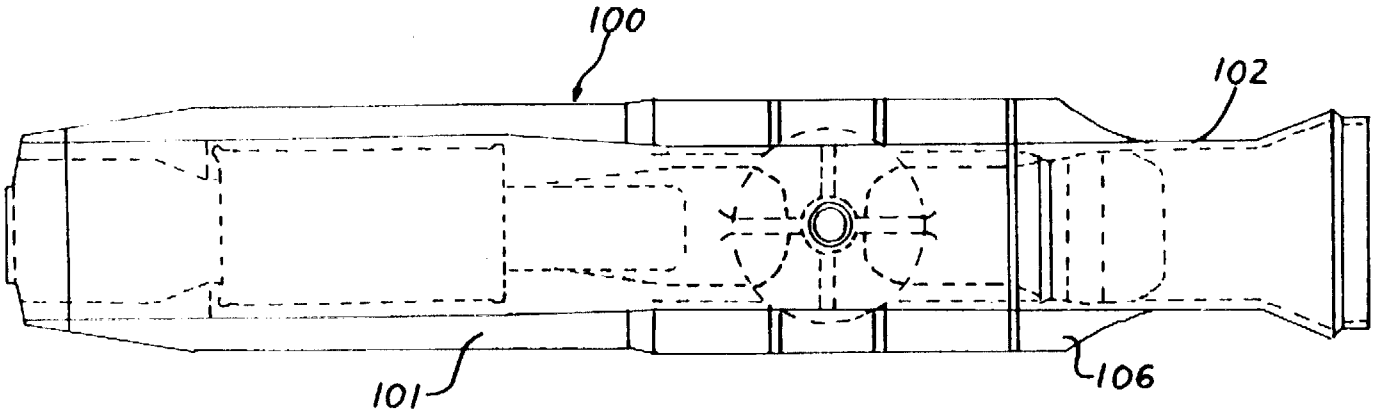
FIG. 10 is a plan view of a draft arm and transition member of the invention.
Figure 11:
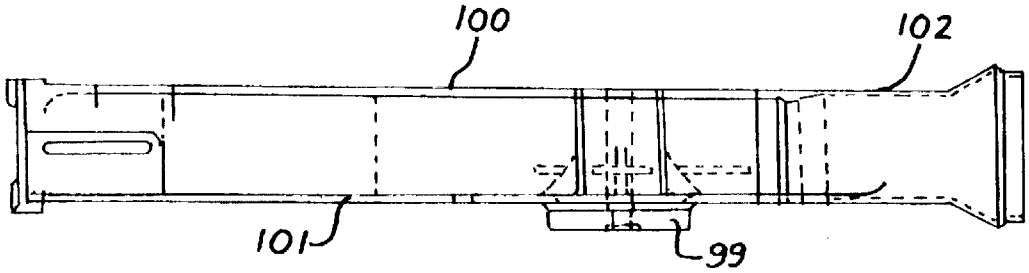
FIG. 11 is a side elevation view of the draft arm and transition member of FIG. 10.

Referring to FIG. 2, the discharge openings 26 of the hopper car 10 are located in series along both sides of the center sill 40. The discharge openings 26 are closable for selective discharge of bulk commodities. Referring to FIGS. 10 and 11, the car body 14 includes underframe members or draft arms 100 connecting the center sill 40 to the spaced trucks 12. The underframe members 100 have a shape distinct from the shape of the center sill 40. The undeframe members 100 generally have a flat topped cross-section.

The underframe members 100 have an integral or separable center plate 99 for connecting the underframe members 100 to the trucks 12.

The present invention includes transition members 102 connected to the underframe members 100. The transition members 102 are located in situ between the center sill 40 and underframe members 100. Preferably, the transition members 102 are cast members and are made of Grade "B" cast steel. The transition members 102 are sized and shaped to fit with the underframe members 100. Each underframe member 100 extends into the transition member 102 approximately two inches. After the underframe member 100 extends into the transition member 102, the underframe member 100 and transition member 102 are welded together. Alternatively, in another embodiment, the underframe member 100 and the transition member 102 are a one-piece member. This one-piece underframe member with a transitioning end is similar to the two-piece embodiment depicted in FIGS. 10 and 11. The underframe member 100 has a hollow rectangular cross-section with a flat top and a flange 101 extending along the length of the underframe member body for stress distribution.

Figure 4:
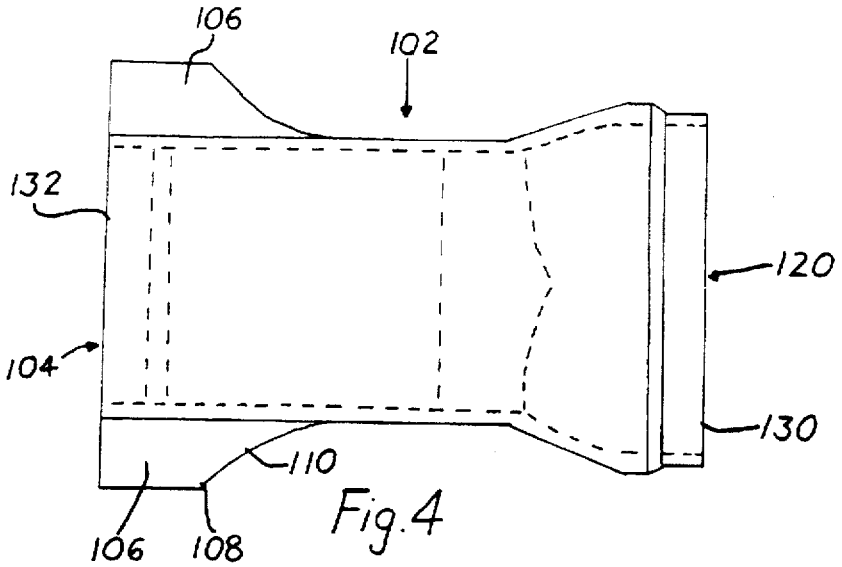
FIG. 4 is a plan view of a transition member of the preferred embodiment of FIG. 1.
Figure 5:
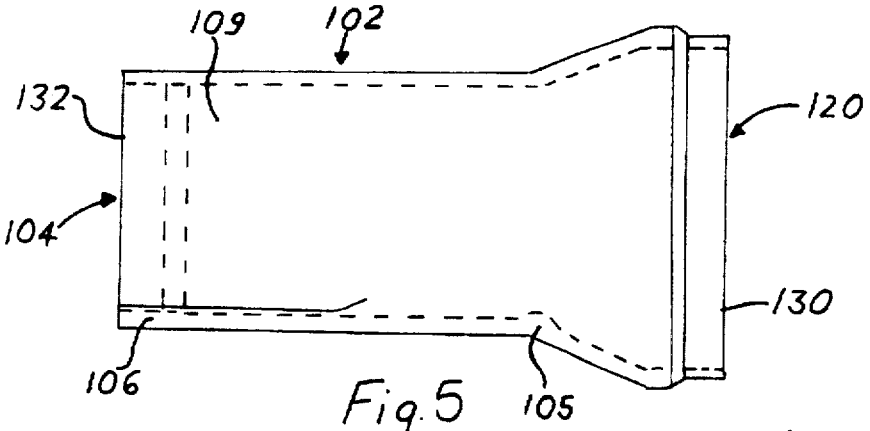
FIG. 5 is a side elevation view of the transition member of FIGS. 1 through 4.
Figure 6:
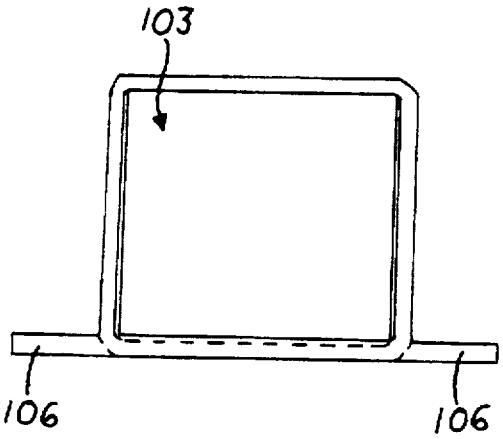
FIG. 6 is a first end view of the transition member of FIGS. 1 through 5 taken from the left in FIG. 5.
Figure 7:
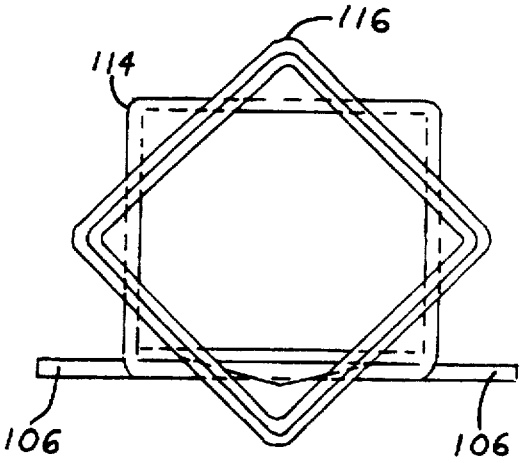
FIG. 7 is an opposite end view of the transition member of FIGS. 1 through 6 taken from the right in FIG. 6.

Referring to FIGS. 4—9, the transition member 102, at the end 104 where the underframe member 100 fits in the transition member 102, has a hollow rectangular cross-section 103 with a flat top, bottom and sides. The wall at this end 104 is thin relative to the cross-section of the mating underframe member 100 and has a uniform thickness on all sides. Referring to FIG. 5, the transition member 102 has added material 105 to increase the wall thickness at this point for better stress distribution. Two fin-shaped transition member flanges 106, designed for stress distribution, project out the sides of the transition member 102 at the end 104, near the bottom of the transition member 102. The fin-shaped transition member flanges 106 are sized and located to mate with the flanges 101 of the underframe member 100.

Figure 9:
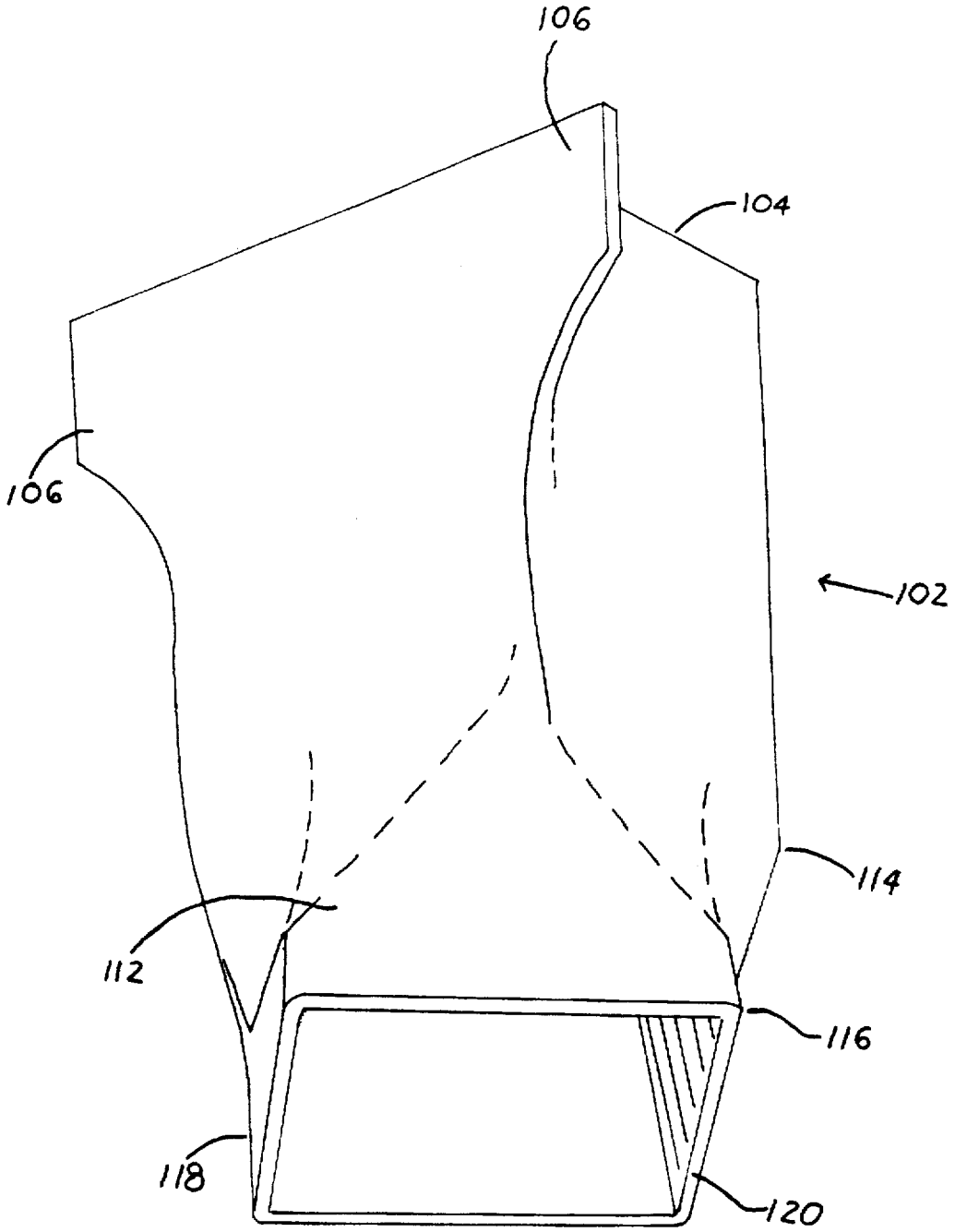
FIG. 9 is a rotated second, bottom perspective view of the transition member of FIGS. 1 through 8.

FIG. 4 shows a plan view of the fin-shaped flanges 106 of the preferred embodiment of the transition member 102. The flanges have a two-curvature shape. Beginning with the curvature located closest to the end 104, the fin-shaped flange 106 is shaped with a curve or bend 108 toward the transition member body 109 that has a center point within the flange 106 and a radius less than the width of the flange 106. The flange 106 then curves or bends 110 away from the transition member body 109. This curve 110 has a center point outside of the flange 106 and a radius greater than the width of the flange that allows the flange 106 to form into the side of the transition member body 109, thereby creating a fin-shaped look. FIG. 9 shows the underside of the transition member 102 illustrating the fin-shaped flanges 106 as a formed part of the transition member 102. The fin-shaped flanges 106 have a uniform thickness at the end 104 with a gradual increase in thickness near the point where the flange 106 forms into the side of the transition member body 109. This increase in thickness provides for better stress distribution.

Figure 8:
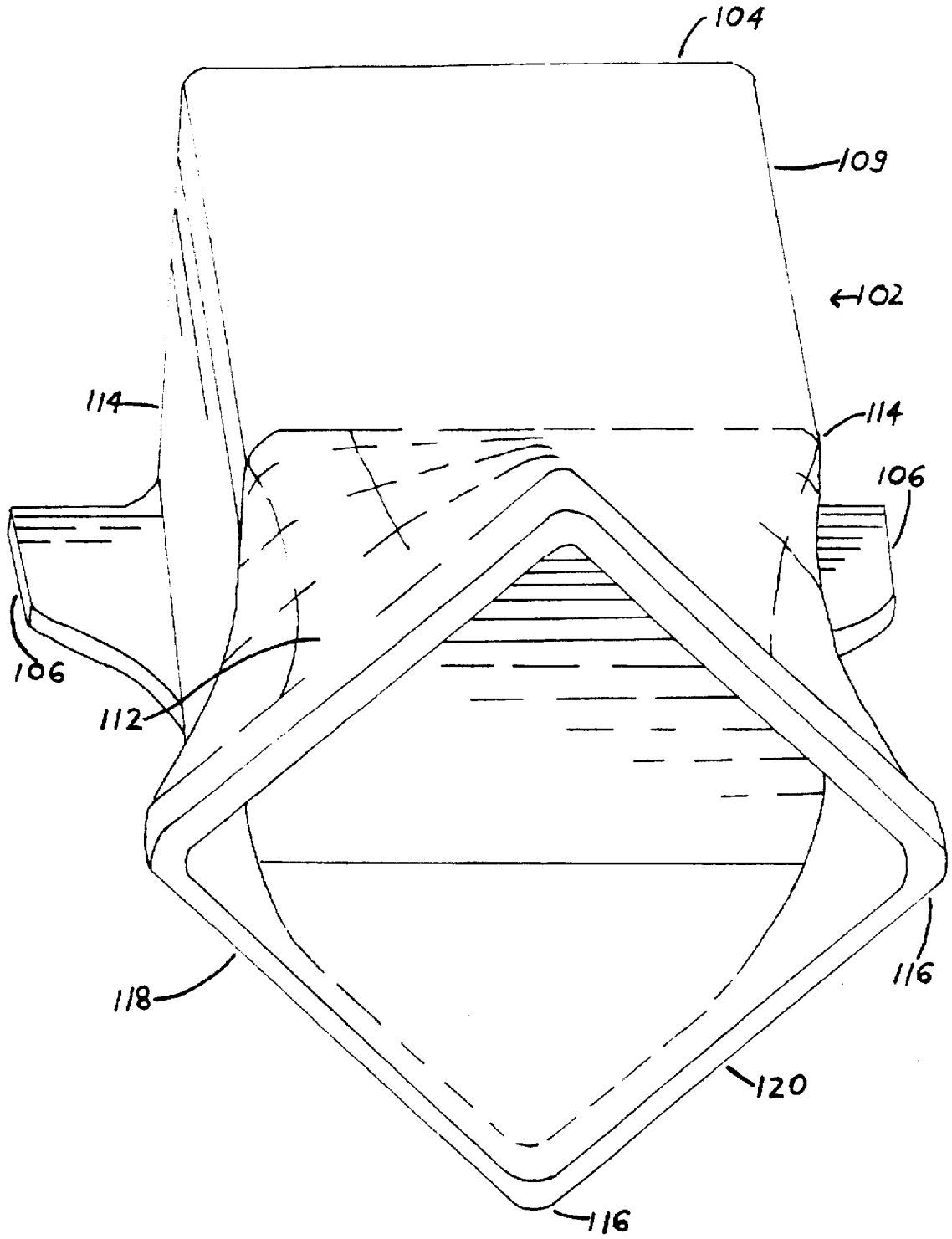
FIG. 8 is a first, top perspective view of the transition member of FIGS. 1 through 7.

Referring to FIG. 8, the transition member 102, near the end 120 of the transition member 102, transitions or rotates and changes its cross-sectional shape. Advantageously, the cross-sectional shape transition is made inboard of the inboard axles of the truck 12. This location of the cross-sectional shape transition between the underframe member 100 and the center sill 40 prevents the rotated center sill 40 from interfering with the axles of the trucks 12.

In the transition area 112, the cross-sectional thickness of the walls increase while the cross-sectional area of the hollow opening 103 decreases. The exterior of the transition member 102 in the transition area 112 has a rounded shape with curvatures forming from the corners 114 of the rectangular transition body 109 to the corners 116 of the diamond-shaped transition body 118 at the end 120. At the end 120 of the transition, a hollow diamond-shaped cross-section remains with walls having a uniform thickness approximately the same as the wall thickness at end 104. The end 120, has an uppermost corner with sloping sides extending to side corners. The transition member 102 at the end 120 is sized and shaped to fit with the center sill 40. The center sill 40, which extends along the length of the car body 14, has sloped surfaces because the conventional rectangular cross-section of the center sill 40 is preferably rotated with a rounded corner uppermost of the center sill 40 and side surfaces sloped from the uppermost rounded corner toward the discharge openings 26. In a preferred embodiment, the transition member 102 transitions between the center sill 40 and 5 underframe members 100, thereby allowing the center sill 40 to have sloped surfaces with an uppermost rounded corner while the underframe members 100 have other shapes.

Referring to FIGS. 4 and 5, in another embodiment, the transition members 102 have a center sill connection portion 130 having a rotated, hollow, square cross-section for mating with the center sill 40, with a rounded corner uppermost of the center sill connection portion 130, and an underframe member connection portion 132 having a hollow, square cross-section with a side surface uppermost of the underframe member connection portion 132.

In yet another embodiment, the transition member 102 is located in situ between the center sill 40 and the underframe member 100 connecting the car body 14 to the spaced trucks 12. The transition member 102 has a center sill connection portion 130 sized and shaped to fit with the center sill 40, and an underframe connection portion 132 sized and shaped to fit with the underframe member 100. The transition member 102 in situ transitions between the center sill 40 and underframe member 100 allowing the center sill 40 to have sloped surfaces with an uppermost rounded corner while the underframe member 100 has another shape.

Those of ordinary skill in the art will recognize that modifications can be made to the transition casting described herein without departure from the true spirit and scope of the invention. This true spirit and scope of the invention is defined by the appended claims, to be interpreted in light of the foregoing specification.

What is claimed is:

1. A railroad hopper car for carrying loaded commodities, comprising:

spaced trucks; and a car body supported on the spaced trucks;

the car body including an underframe having a center sill, with discharge openings, the center sill in the area of the discharge openings toward the loaded commodities having surfaces sloped toward the discharge openings;

the underframe having members connecting the car body to the spaced trucks, these members having shapes distinct from the shape of the center sill;

the car body further including transition members between the center sill and underframe members connecting the car body to the spaced trucks, the transition members along the center sill being sized and shaped to fit with the center sill, the transition members each having a center sill connection portion having a substantially square cross-section rotated with a corner uppermost of the center sill connection portion, and the transition members along the underframe members being sized and shaped to it with the underframe members;

whereby the transition members transition between the center sill and underframe members, allowing the center sill to have sloped surfaces while the underframe members have other shapes.

2. A railroad hopper car as in claim 1, the center sill having an upper portion, facing the loaded commodity, the upper portion having a generally triangular cross-section, the transition members along the center sill having a mating triangular cross-section.

3. A railroad hopper car as in claim 2, the underframe members having a flat topped cross section, the transition members along the underframe members having a mating flat topped cross section.

4. A railroad hopper car as in claim 1, the trucks including inboard and outboard axles and wheels on the inboard and outboard axles, the transition members transitioning between the center sill and underframe members clear of the inboard axles.

5. A railroad hopper car as in claim 4, the transition members along the underframe members, and inboard of the inboard axles, being sized and shaped to fit with the underframe members, whereby the transition members transition to the center sill clear of the inboard axles.

6. A railroad hopper car as in claim 1, the transition members being cast members.

7. A railroad hopper car as in claim 1, the center sill in the area of the discharge openings toward the loaded commodities having a square cross-section rotated with a corner uppermost of the center sill and side surfaces sloped from the uppermost corner toward the discharge openings; the underframe having members connecting the car body to the spaced trucks, these members having square cross-sections rotated with a side surface uppermost of the underframe members, the transition members each having an underframe member connection portion with a square cross-section rotated with a side surface uppermost of the underframe member connection portion.

8. A transition member for connection of the underframe and center sill of the car body of a railroad hopper car for carrying loaded commodities, the railroad hopper car including spaced trucks, and the car body being supported on the spaced trucks, the car body further including discharge openings, the center sill in the area of the discharge openings toward the loaded commodities having surfaces sloped toward the discharge openings, and the underframe having members connecting the car body to the spaced trucks, these members having shapes distinct from the shape of the center sill, the transition members being located in situ between the center sill and underframe members connecting the car body to the spaced trucks, the transition members along the center sill being sized and shaped to fit with the center sill, the transition members each having a center sill connection portion having a substantially square cross-section rotated with a corner uppermost of the center sill connection portion, and the transition members along the underframe members being sized and shaped to fit with the underframe members; whereby the transition members transition between the center sill and underframe members, allowing the center sill to have sloped surfaces while the underframe members have other shapes.

9. The transition member of claim 8, the center sill of the railroad hopper car in the area of the discharge openings toward the loaded commodities having a square cross-section rotated with a corner uppermost of the center sill and side surfaces sloped from the uppermost corner toward the discharge openings, the underframe having members connecting the car body to the spaced trucks, these members having square cross-sections rotated with a side surface uppermost of the underframe members, the transition members each having an underframe member connection portion with a square cross-section rotated with a side surface uppermost of the underframe member connection portion.

10. A transition member for connection of the underframe and center sill of the car body of a railroad hopper car, the transition member being located in situ between a center sill and underframe member connecting the car body to the spaced trucks, the transition member having a center sill connection portion sized and shaped to fit with the center sill, the center sill connection portion having a substantially square cross-section rotated with a corner uppermost of the center sill connection portion, and the transition member also having an underframe connection portion sized and shaped to fit with the underframe member;

whereby the transition member in situ transitions between the center sill and underframe member, allowing the center sill to have sloped surfaces while the underframe member has another shape.

11. The transition member of claim 10, the center sill of the railroad hopper car in the area of the discharge openings toward the loaded commodities having a square cross-section rotated with a corner uppermost of the center sill and side surfaces sloped from the uppermost comer toward the discharge openings, the underframe having members connecting the car body to the spaced trucks, these members having square cross-sections rotated with a side surface uppermost of the underframe members, the transition members each having an underframe member connection portion with a square cross-section rotated with a side surface uppermost of the underframe member connection portion.

* * * * *